US011127549B2

(12) United States Patent
Dumont et al.

(10) Patent No.: US 11,127,549 B2
(45) Date of Patent: Sep. 21, 2021

(54) MANUAL CONTROL DEVICE FOR A REMOTELY OPERATED SOURCE INVERTER

(71) Applicant: SOCOMEC, Benfeld (FR)

(72) Inventors: Roger Dumont, Benfeld (FR); Olivier Robert, Ebersheim (FR)

(73) Assignee: SOCOMEC, Benfeld (FR)

( * ) Notice: Subject to any disclaimer, the term of this patent is extended or adjusted under 35 U.S.C. 154(b) by 0 days.

(21) Appl. No.: 17/256,444

(22) PCT Filed: Jun. 28, 2019

(86) PCT No.: PCT/FR2019/051601

§ 371 (c)(1),
(2) Date: Dec. 28, 2020

(87) PCT Pub. No.: WO2020/002850

PCT Pub. Date: Jan. 2, 2020

(65) Prior Publication Data

US 2021/0249205 A1 Aug. 12, 2021

(30) Foreign Application Priority Data

Jun. 29, 2018 (FR) ..... 1855932

(51) Int. Cl.
*H01H 19/62* (2006.01)
*H01H 9/02* (2006.01)

(52) U.S. Cl.
CPC ..... *H01H 19/62* (2013.01); *H01H 9/0264* (2013.01)

(58) Field of Classification Search
CPC .. H01H 9/26; H01H 50/323; H01H 2009/307; H01H 2300/018; H01H 9/56;
(Continued)

(56) References Cited

U.S. PATENT DOCUMENTS 3,875,360 A 4/1975 Rys

FOREIGN PATENT DOCUMENTS

DE 1071195 B 9/1958
EP 0417015 A1 3/1991
(Continued)

OTHER PUBLICATIONS

International Search Report and Written Opinion from PCT Application No. PCT/FR2019/051601, dated Oct. 25, 2019.
(Continued)

*Primary Examiner* — Ahmed M Saeed
(74) *Attorney, Agent, or Firm* — Workman Nydegger

(57) ABSTRACT

A device for controlling the switching of the contacts in an electrical apparatus comprises a unit inside, which are mounted a control lever in a pivot connection with the unit between two positions, a rotating element connected to the lever, and an actuating shaft connected between the rotating element and electrical contacts. The device further comprises a torsion spring mounted between the control lever and the rotating element, and a first and a second pawl scissor-mounted via a torsion spring, the first pawl cooperating with a first cam track of the lever to disengage the first pawl from a first stop and release the rotating element, and the second pawl cooperating with a second cam track of the lever to disengage the second pawl from a second stop and release the rotating element.

10 Claims, 12 Drawing Sheets

(58) Field of Classification Search
CPC ..... H01H 9/085; H01H 9/06; H01H 9/104; H01H 9/16; H01H 9/38; H01H 13/08; H01H 71/70; H01H 9/061; H01H 9/42; H01H 9/52; H01H 11/00; H01H 13/18; H01H 13/562; H01H 2003/266; H01H 2009/108; H01H 2071/328; H01H 2071/665; H01H 2203/00; H01H 2235/01; H01H 31/003; H01H 35/14; H01H 3/20; H01H 3/3005; H01H 71/125; H01H 71/2409; H01H 71/322; H01H 71/46; H01H 71/74; H01H 9/0072; H01H 9/34; H01H 9/40; H01H 19/62; H01H 19/635; H01H 2009/267; H01H 2050/325; H01H 36/00; H01H 3/26; H01H 3/264; H01H 3/30; H01H 3/36; H01H 51/12; H01H 71/1045; H01H 71/52; H01H 71/521; H01H 7/04; H01H 85/547; H01H 9/063; H01H 9/262; H01H 9/28; H01H 9/286; H01H 9/54
See application file for complete search history.

(56) References Cited

FOREIGN PATENT DOCUMENTS

| | | | |
|---|---|---|---|
| EP | 2161730 | A1 | 3/2010 |
| EP | 2650892 | A1 | 10/2013 |
| EP | 3016127 | A1 | 5/2016 |

OTHER PUBLICATIONS

Search Report from corresponding FR Application No. FR1855932, dated Mar. 13, 2019.

MANUAL CONTROL DEVICE FOR A REMOTELY OPERATED SOURCE INVERTER

BACKGROUND

The invention relates to low-voltage electrical apparatuses and more specifically automatic switches including a control for manual opening and/or closing of the contacts for maintenance.

The invention more specifically relates to the manual control for opening and/or closing of the contacts in an electrical apparatus and its operation with respect to the automatic control.

Often, on remote-controlled apparatuses of this type, the manipulation is said to be dependent, i.e. the contacts are displaced as a function of the operation speed.

However, it is very dangerous to perform operations under load with a manual control dependent on the manipulation speed of the operator.

From the patent application EP 0 417 015 there is known a device for controlling the opening and/or closing of the contacts in an electrical apparatus comprising a control crank linked in an articulated manner to a frame and rotationally driven by a control member between a first position corresponding to a closed position of the contacts and a second position corresponding to an open position of the contacts. The device further comprises a compression spring linked in an articulated manner by a first of its ends to the control crank, and mechanically linked to the movable contact by a second end opposite the first. The device further comprises a connecting rod linked in an articulated manner by a first of its ends to the crank and mechanically linked to the movable contact by a second end opposite the first. The spring is configured to be compressed, by its first end, by the crank, up to a so-called dead point passing position from which the spring becomes driving and acts, when it decompresses, on the movable contact and the control crank in such a way as to displace the movable contact.

The control of such a device is performed by a single operation.

From document EP 2 161 730 there is also known a device for controlling the contacts of an electrical cut-off device comprising a frame, a manipulating crank coupled to a crank for actuating a camshaft via a connecting rod, the camshaft being linked to a device for driving the contacts, a crank for coaxial compression with the manipulating crank and coupled to a guide rod via a manipulating spring, a manipulating lever driving the compression crank using the manipulating shaft, a lock provided with a notch to retain the control crank, and therefore the movable contact, in its initial contacts-open position during the compression of the manipulating spring before the passing of the spring beyond a dead point passing line, a lifting finger provided on the manipulating crank driving the lock, once the dead-spot passing line is exceeded, to release the manipulating crank from the notch in which it was retained, and a stop for closing the compression crank configured to be in contact with the drive shaft of the manipulating crank once the manipulating crank is released from the notch, and a device for multiplying the control force.

The device makes it possible to drive the shaft via the connecting rod autonomously under the effect of the manipulating spring, once the manipulating lever has exceeded the dead spot passing line. This operation is actuated both during a closing manipulation and during an opening manipulation of the device.

But the device described in the document above is complex and comprises a large number of parts giving rise to considerable bulk, particularly in an axial direction defined by the axis of rotation of the manipulating crank.

Furthermore, the generally-known solutions do not separate the manual action from the automatic action for manipulating the contacts which endangers the safety of the operator.

SUMMARY

The aim of the invention is to palliate the drawbacks mentioned above by proposing a device for controlling the switching of the contacts in an electrical apparatus, the device being of small bulk and allowing under any circumstances the transition from automatic control to manual control with a handle operation speed completely independent of the speed of the contacts. The invention also has the purpose of providing such a device, and also allowing the forcing of the switches in the event of the latter being welded.

In a subject of the invention, provision is made for a device for controlling the switching of the contacts in an electrical apparatus comprising a unit inside which are mounted a control lever in a pivot connection with the unit and configured to be rotationally displaced between a first position corresponding to a position wherein the contacts are closed on a primary power supply and a second position corresponding to a position wherein the contacts are closed on a secondary power supply, a rotating element connected to the lever by an intermediate shaft, an actuating shaft mechanically connected to the rotating element and to electrical contacts and configured to pivot between a first and a second position to switch between the electrical contacts, the unit further comprising a slot traversed by the lever to allow it to be actuated from outside the unit in the manual operating mode of the device.

According to a general feature of the invention, the device for controlling the switching of the contacts further comprises a torsion spring including a first end cooperating with the control lever and a second end cooperating with the rotating element, and a first pawl and a second pawl scissor-mounted via a torsion spring, the first pawl cooperating, in a manual operating mode of the device, with a first stop of the rotating element in a first position of the rotating element and with a first cam track of the control lever to disengage the first pawl from the first stop and release the rotating element, and the second pawl cooperating, in a manual operating mode of the device, with a second stop of the rotating element in a second position of the rotating element and with a second cam track of the control lever to disengage the second pawl from the second stop and release the rotating element.

The control device according to the invention thus makes it possible to have a movement of the contacts that is fast and independent of the actuating speed of the control lever with a minimum of parts and thus a reduced bulk.

According to a first aspect of device for controlling the switching of the contacts, the unit can comprise a cowling displaceable between an open position and a closed position, the cowling being configured to, in the closed position, prevent access to the control lever and disengage the first and second pawls from the rotating element to prevent any cooperation between the pair of pawls and the rotating element and allow the operation of the device in an automatic mode, and to, in the open position, engage the first and second pawls in contact with the rotating element and allow the operation of the device in manual mode.

The cowling makes it possible to prevent any accidental mechanical interaction between the outside environment and the control lever.

The shape of the cowling makes it possible to engage the pawls in the rotating element when the cowling opens and thus allow the automation of the device's transition to manual mode when the cowling opens.

According to a second aspect of the device for controlling the switching of the contacts, the cowling can be transparent so as to be able to visually check the current state of the control device, and thus the current state of the contacts, namely open or closed.

According to a third aspect of the device for controlling the switching of the contacts, the device can further comprise at least one switch mechanically cooperating with the cowling to enable or cut off the electrical power supply of the control device allowing its operation in automatic mode and/or to enable or disable the sending of an item of information relating to the electrical power supply of the control device for its operation in automatic mode.

The combination of the shape of the cowling and the presence of the switch makes it possible to automate the transition of the device to automatic mode when the cowling closes by disengaging the pawls and by enabling the electrical power supply of the control device.

According to a fourth aspect of the device for controlling the switching of the contacts, the cowling can be kept in the closed position by a screw that is removable using a screwdriver.

The closing of the cowling by a removable screw makes it possible to prevent access to the control lever by a user without tools and thus limit undesirable actuations of the control lever.

Furthermore, the cowling can comprise an orifice cooperating with a housing of the unit allowing the sealing of the cowling, i.e. a permanent closing of the cowling to prevent access thereto.

According to a fifth aspect of the device for controlling the switching of the contacts, the unit can further comprise an additional slot arranged facing an actuator directly engaging with the actuating shaft and allowing the manual forcing of the opening or closing of the contacts, and an internal cowling mounted in translation between an idle position wherein the internal cowling covers the additional slot and a working position wherein the internal cowling gives access to the additional slot.

The internal cowling in translation masks the access to the actuator, thus preventing the accidental forcing of the contacts.

Furthermore, the internal cowling comprises an internal extension arranged between the unit and the pawls shaped to disengage the pawls from the rotating element when the cowling is positioned in a position wherein the additional slot is accessible, and to engage the pawls with the rotating element when the cowling is in a position wherein the additional slot is inaccessible.

According to a sixth aspect of the device for controlling the switching of the contacts, the unit can further comprise an elastic means making it possible to return the internal cowling to its idle position after a transition to the working position.

The elastic means thus makes it possible to keep a default configuration of the control device wherein the actuator for forcing the contacts cannot be accessed without a deliberate action being performed and maintained to give access to the access slot and allow the insertion of a tool into the slot to actuate the actuator.

According to a seventh aspect of the device for controlling the switching of the contacts, the cowling can cover, in the closed position, the internal cowling, preventing any manual access to the additional slot.

According to an eighth aspect of the device for controlling the switching of the contacts, the device can further comprise an ergonomic handle attached to a free end of the control lever.

BRIEF DESCRIPTION OF THE DRAWINGS

The invention will be better understood on reading the text below, by way of illustration but non-limiting, with reference to the appended drawings wherein.

DETAILED DESCRIPTION OF EMBODIMENTS

Figure 1:
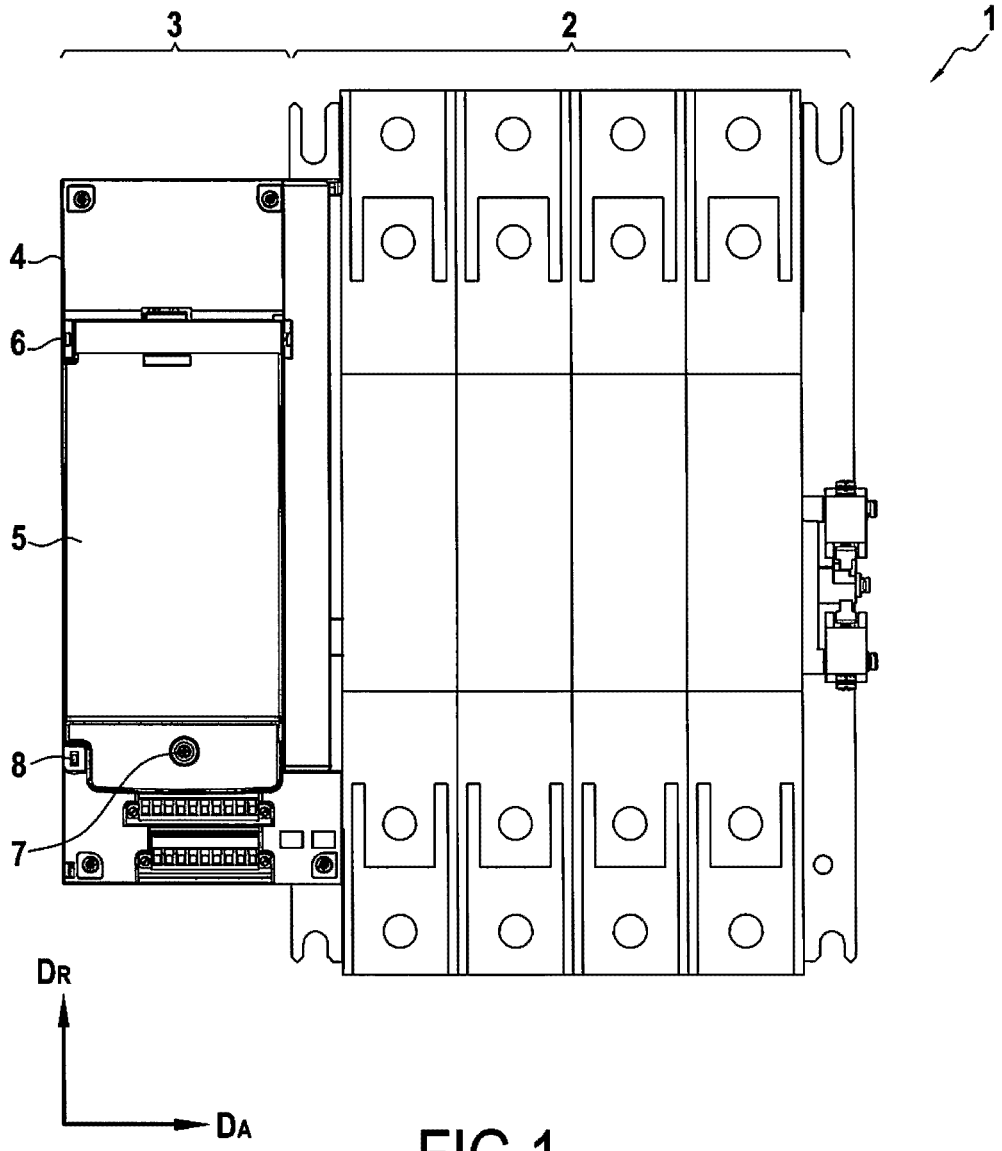
FIG. 1 illustrates a top view of an electrical switching system.

FIG. 1 illustrates a top view of an electrical switching apparatus 1 according to an embodiment of the invention.

The electrical switching apparatus 1 comprises a part 2 intended to make the electrical connections with external electrical apparatuses via electrical contacts that can be displaced between a first position wherein the circuit is closed on a primary power supply and a second position wherein the circuit is closed on a secondary power supply, and a device 3 for controlling the switching of the electrical contacts.

Figure 2:
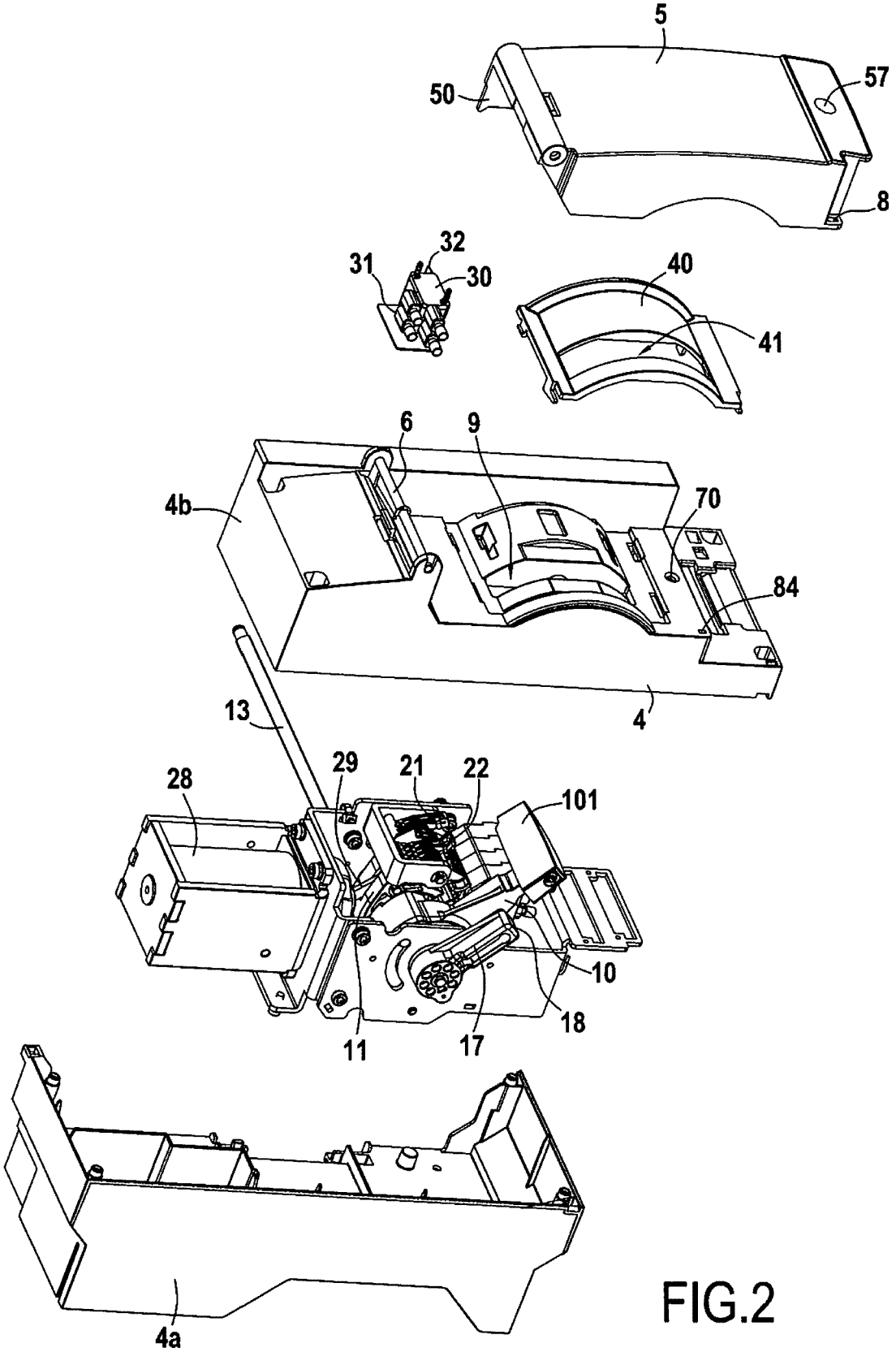
FIG. 2 shows an exploded perspective view of a device for controlling the electrical switching system of FIG. 1 wherein the external cowling has been removed.

FIG. 2 shows an exploded perspective view of the device 3 for controlling the electrical switching apparatus 1 of FIG. 1. The control device 3 comprises a unit 4 onto which is mounted a transparent external cowling 5 capable of pivoting about a shaft 6 attached to the unit 4. The external cowling 5 is held on the unit 4 in the closed position using a screw 7 screwed into a tapped orifice 70 of the unit 4 through an orifice 57 for which provision is made in the external cowling 5.

The external cowling 5 further comprises an orifice 8 cooperating with an orifice 84 for which provision is made in the unit 4 for sealing the external cowling 5 onto the unit 4, i.e. to install a device for checking that the cowling has not been opened in the meantime, the device being able to be a sealed link.

As illustrated in FIG. 2, the unit 4 comprises a lower part 4*a* and an upper part 4*b*. Inside the unit 4 are mounted a control lever 10 in a pivot connection with the unit 4, a rotating element 11 mechanically connected to the control lever 10 by an intermediate mechanical transmission shaft 12 illustrated in FIG. 3 which represents an exploded view of the different actuators of the control device of FIG. 2, and an actuating shaft 13 mechanically connected to the rotating element 11, on the one hand, and to electrical contacts, on the other hand. The actuating shaft 13 defines an axial direction $D_A$ along which the shaft extends, and a radial direction DR extending in a plane orthogonal to the axial direction $D_A$.

The upper part 4*b* of the unit 4 comprises a first slot 9 traversed by the control lever 10 to allow its actuation by a user from the outside of the unit 4 in the manual operating mode of the control device.

Figure 3:
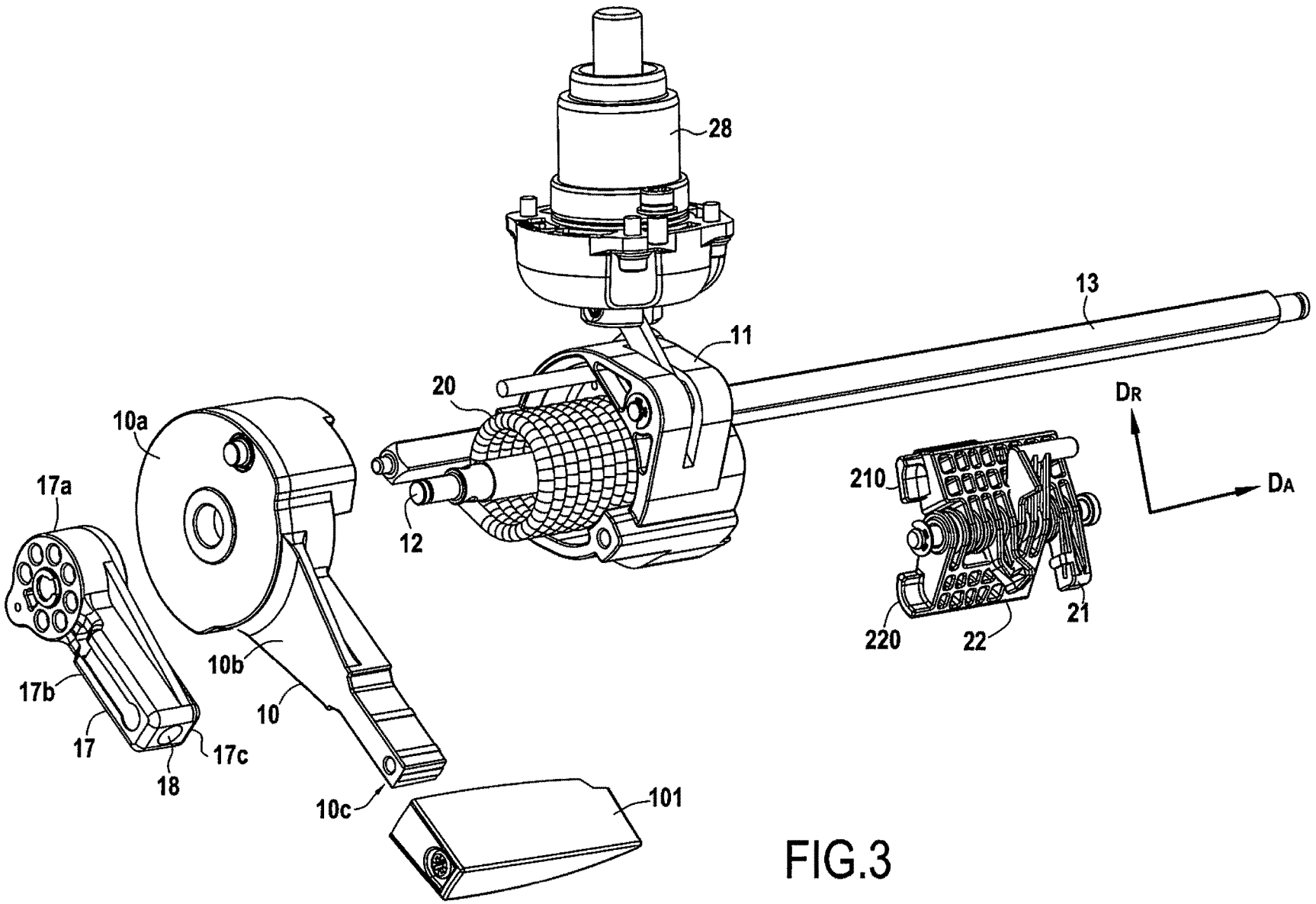
FIG. 3 shows an exploded view of the different actuators of the control device of FIG. 2.
Figure 4:
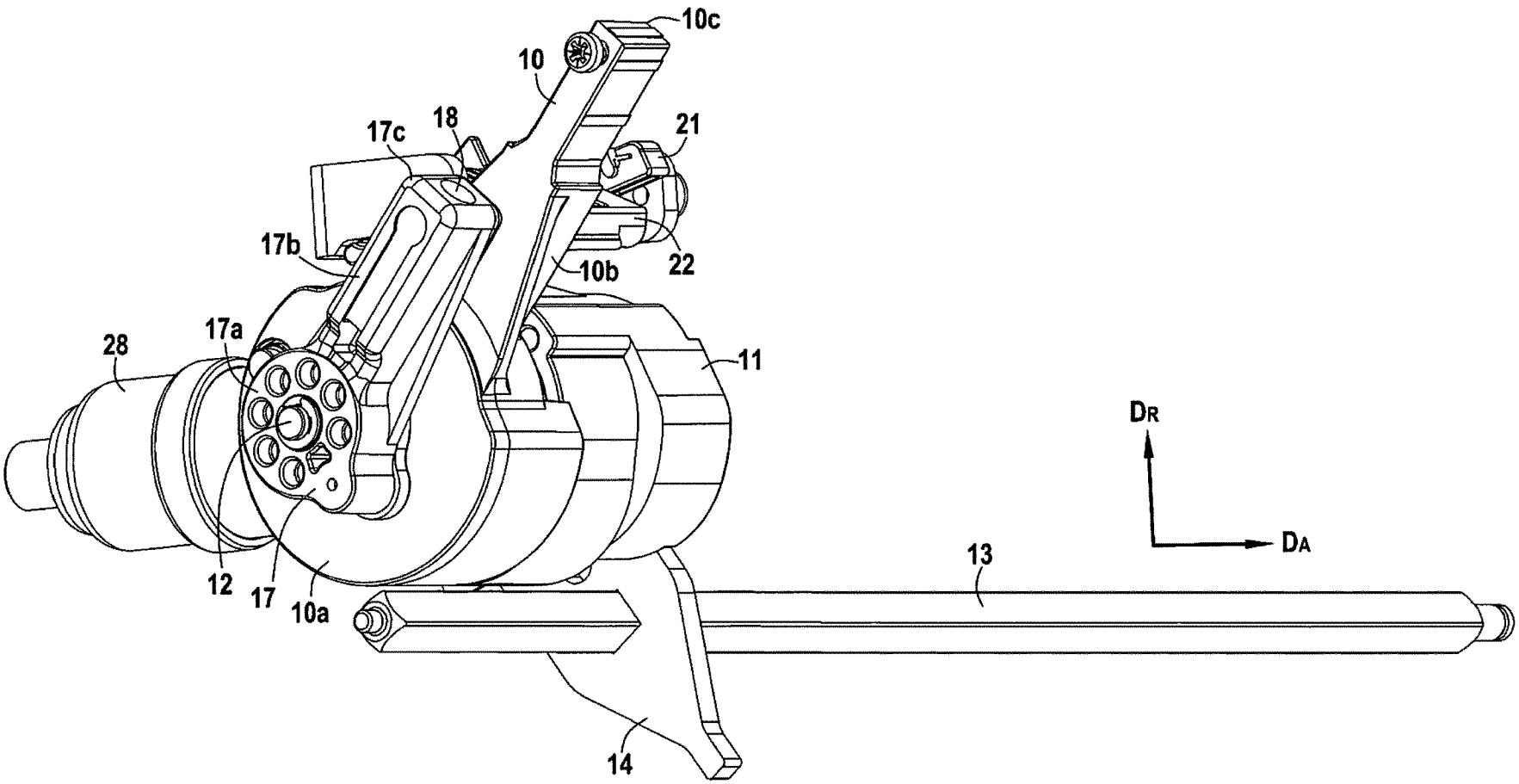
FIGS. 4 and 5 each show a perspective view of the actuators illustrated in FIG. 3 from two separate points of view.

As illustrated in FIG. 3 and also in FIG. 4 which represents an assembled perspective view of the elements of FIG. 3 from a first viewpoint, the control lever 10 comprises a main circular portion 10*a* and an extension 10*b* extending radially in protrusion outward from the main portion 10*a*. The extension 10*b* of the control lever 10 comprises a free end 10*c* on which is mounted an ergonomic handle 101 for actuation of the lever by a user. The control lever 10 is configured to be rotationally displaced between a first position corresponding to the position wherein the circuit is closed on a primary power supply and a second position corresponding to the position wherein the circuit is closed on a secondary power supply.

The rotating element 11 is centered on the same axis of rotation as that of the control lever 10, the axis of rotation being formed by the intermediate shaft 12.

The actuating shaft 13 is offset with respect to the axis of rotation of the control lever 10 and the rotating element 11. The intermediate shaft 12 and the actuating shaft 13 are therefore not coaxial but extend along the axial direction $D_A$. The actuating shaft 13 is configured to pivot between a first and a second position to switch between the electrical contacts.

Figure 5:
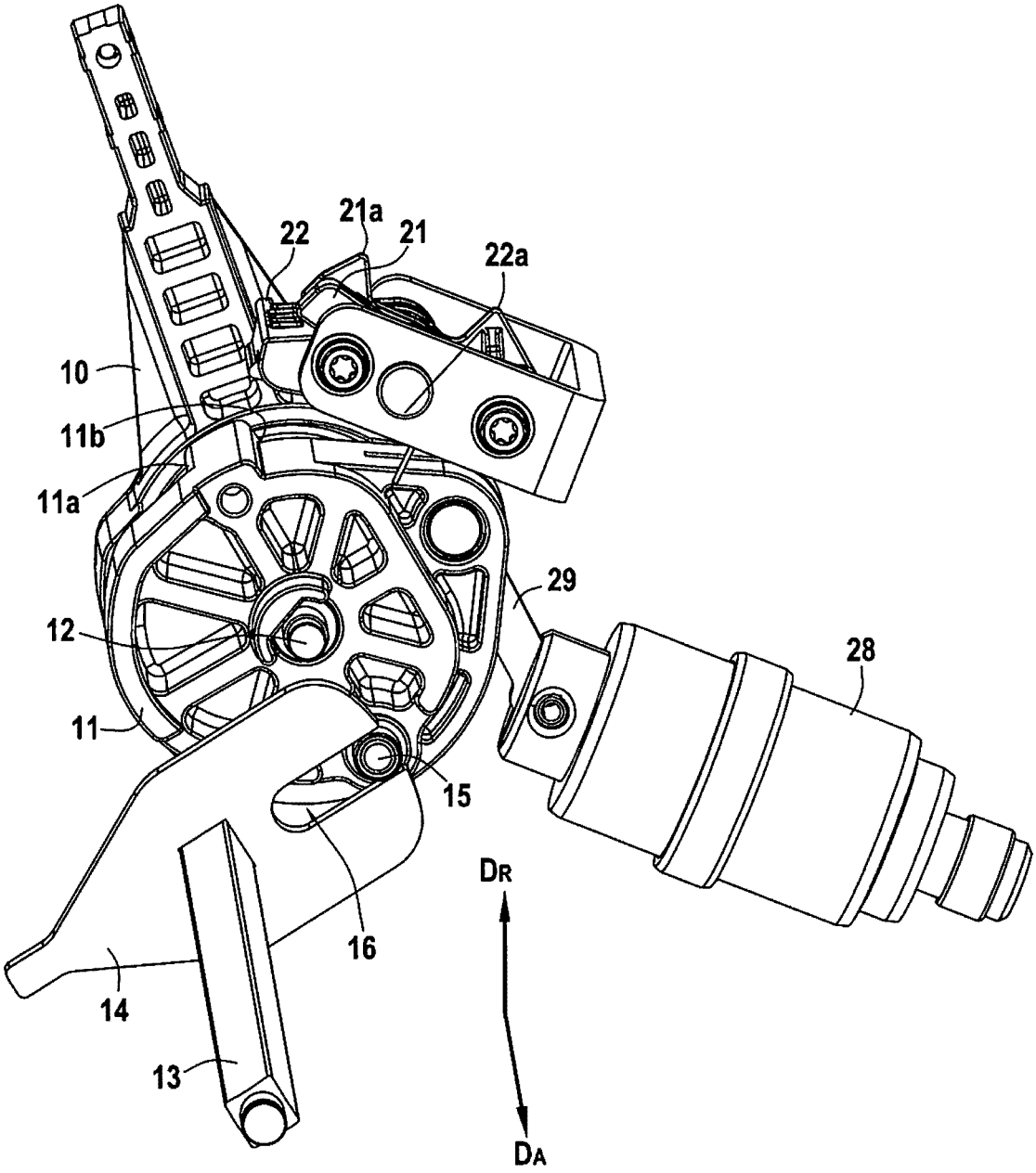

As illustrated in FIG. 5 which represents an assembled perspective view of the elements of FIG. 3 from a second viewpoint, the actuating shaft 13 is driven to pivot using an actuator 14 mounted on the actuating shaft 13 and extending radially with respect to the actuating shaft 13, and a pin 15 mounted on the rotating element 11 and extending in the axial direction $D_A$ opposite to the direction of the control lever 10, i.e. toward the actuator 14. The actuator 14 comprises a slot 16 receiving the pin 15 and into which the pin 15 slides as a function of the position of the rotating element 11. The pin 15 is positioned off the axis of rotation 13 of the rotating element 6. The pin 15 is displaced with the rotating element 11 between two positions respectively corresponding to the first position of the contacts and the second position of the contacts by moving in an arc of a circle between these two positions. The pin 15 oscillates inside the slot 16 of the actuator during the displacement between its two positions.

As illustrated in FIGS. 2 to 4, the control device 3 further comprises a lever 17 for forcing the contacts which is mechanically connected to the control lever 10 via the intermediate shaft 13. The control lever 10, the rotating element 11 and the forcing lever 17 are therefore coaxial. The forcing lever 17 comprises a circular main portion 17*a* and an extension 17*b* extending radially in protrusion outward from the main section 17*a*. The extension 17*b* of the control lever 10 comprises a free end 17*c* in which provision is made for an orifice 18 allowing the insertion of a tool to force the actuation of the actuating shaft 13 and thus force the engagement or disengagement of the electrical contacts. The control lever 10 is mounted, in the axial direction $D_A$, between the forcing lever 17 and the rotating element 11.

Figure 6:
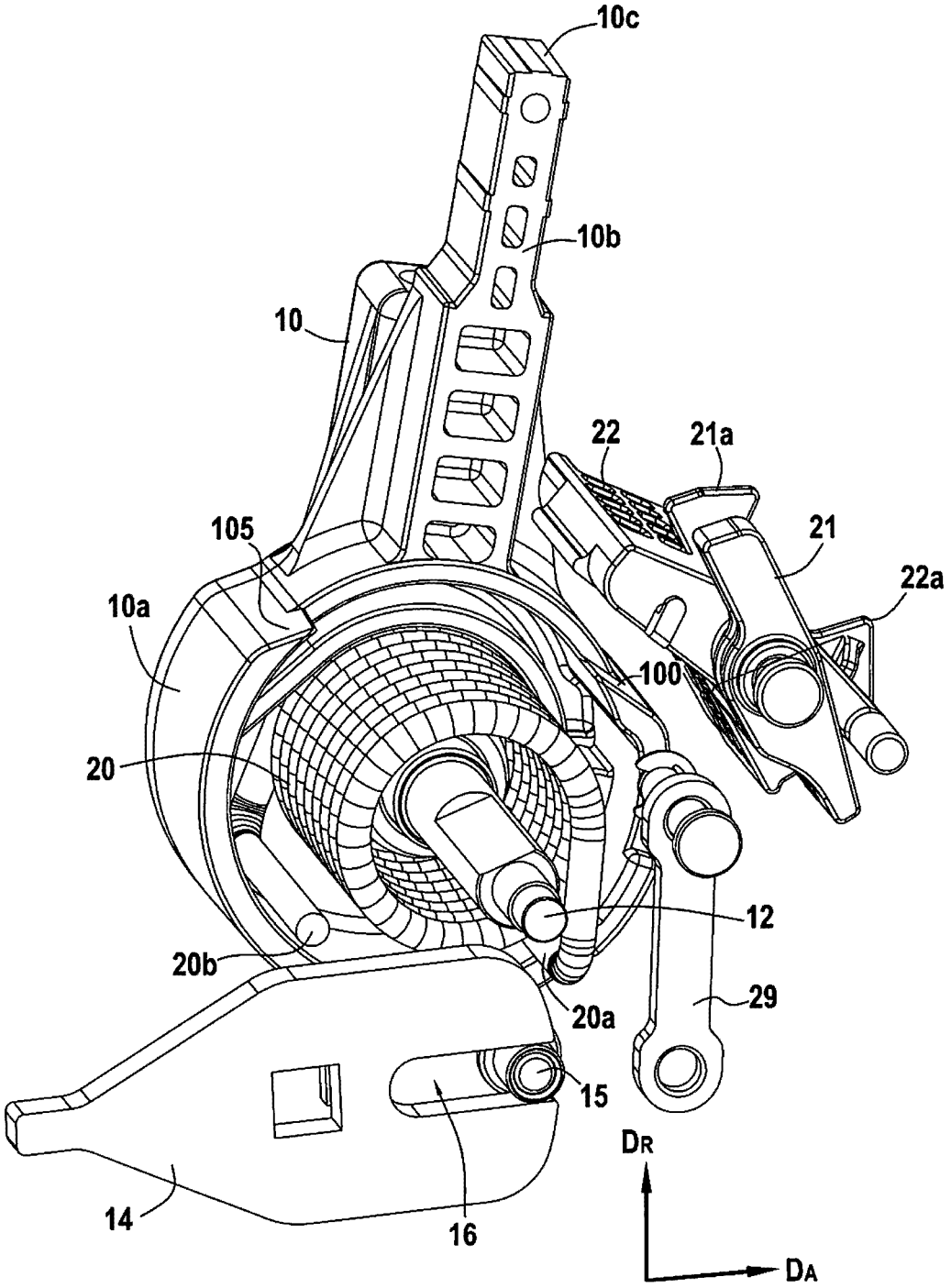
FIGS. 6 and 7 each show a partial view of the representation of FIG. 4 along, respectively, one orientation of the axial direction and the opposite orientation of the axial direction.
Figure 7:
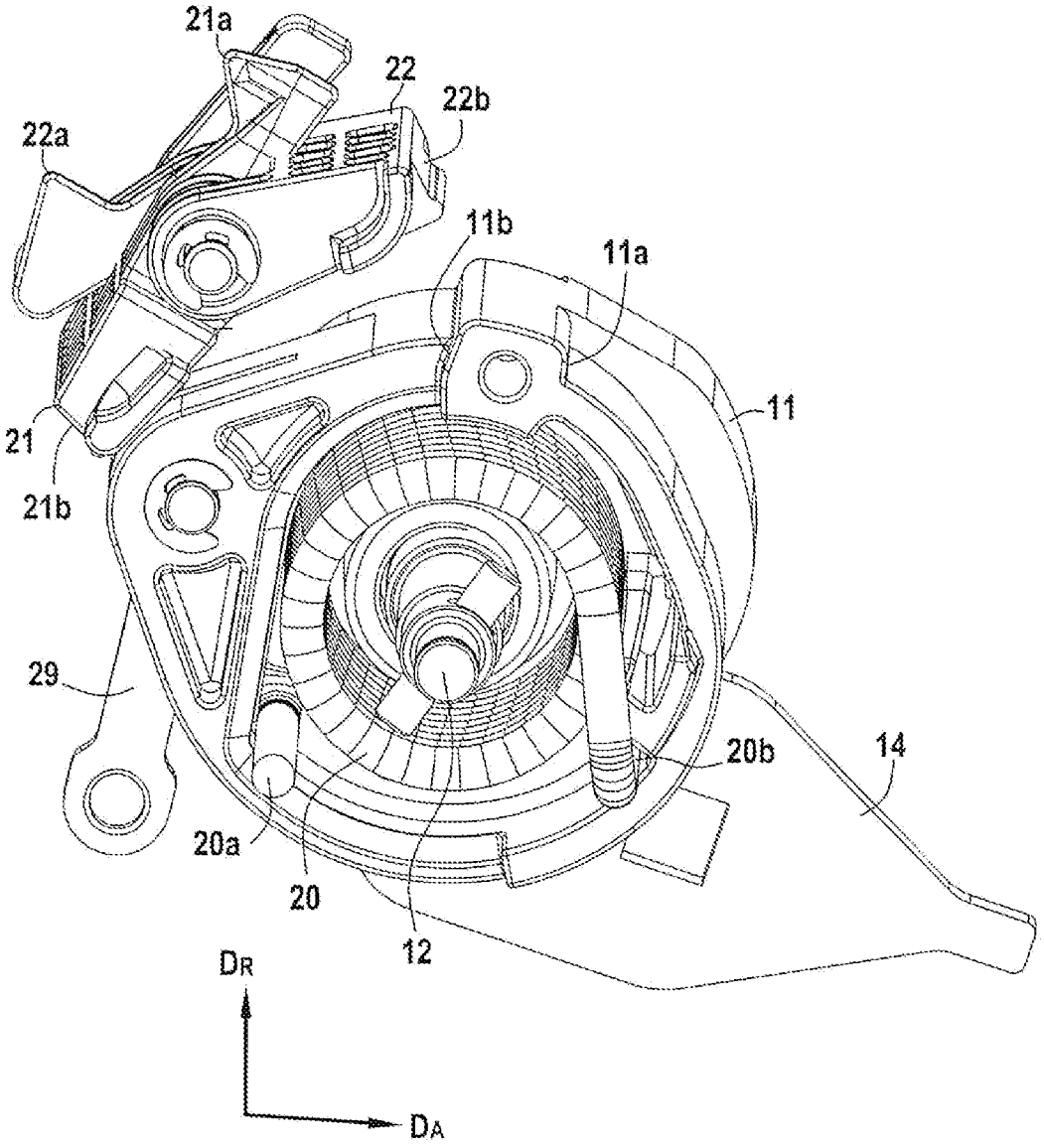

As illustrated in FIG. 3 and also in FIGS. 6 and 7 which each represent a partial view of the representation of FIG. 4 along, respectively, one orientation of the axial direction and the opposite orientation of the axial direction, the control device 3 further comprises a torsion spring 20 mounted between the control lever 10 and the rotating element 11. The torsion spring 20 includes a first end 20*a* cooperating with the control lever 10 and a second end 20*b* cooperating with the rotating element 11.

Figure 8A:
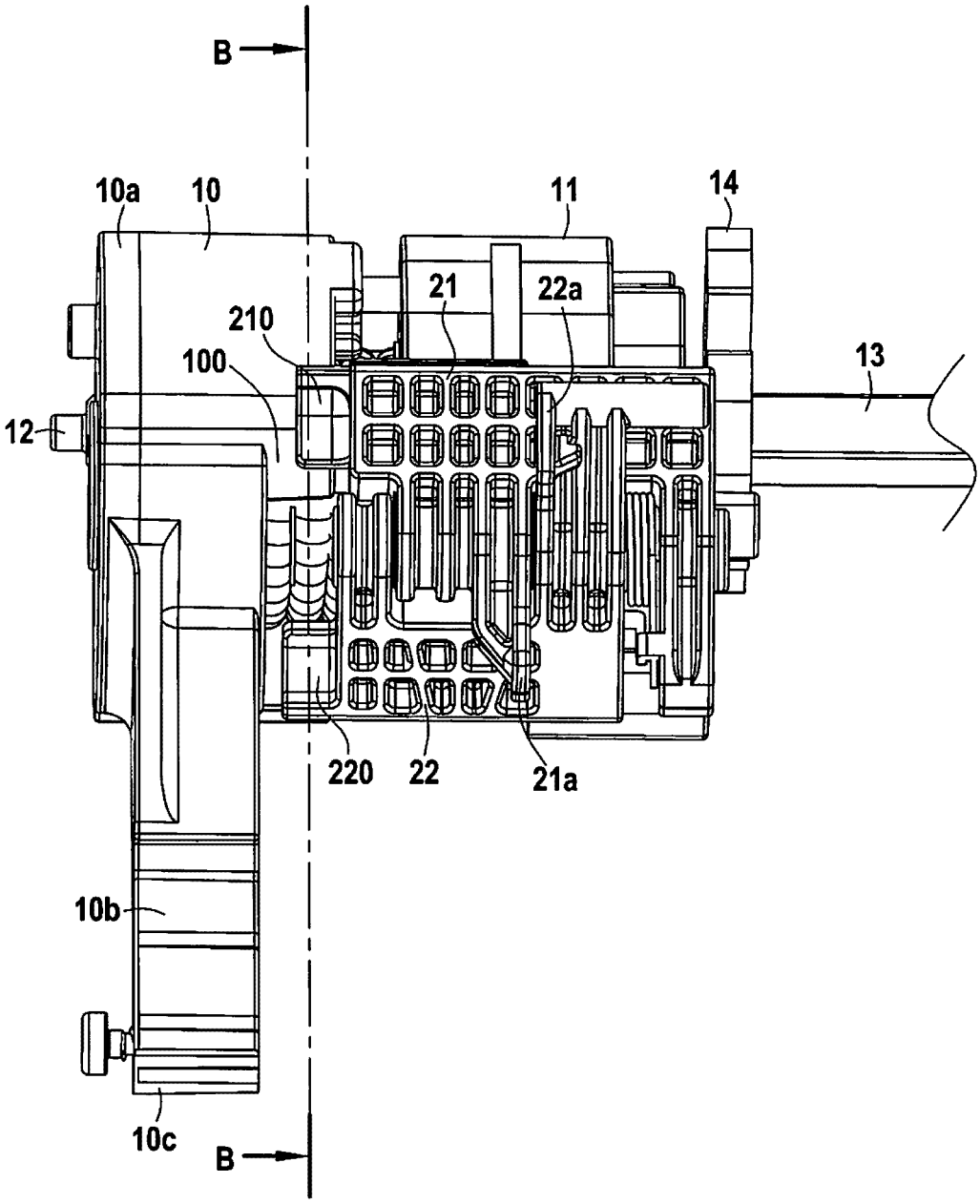
FIG. 8A shows a partial top view of the control device according to an embodiment of the invention.
Figure 8B:
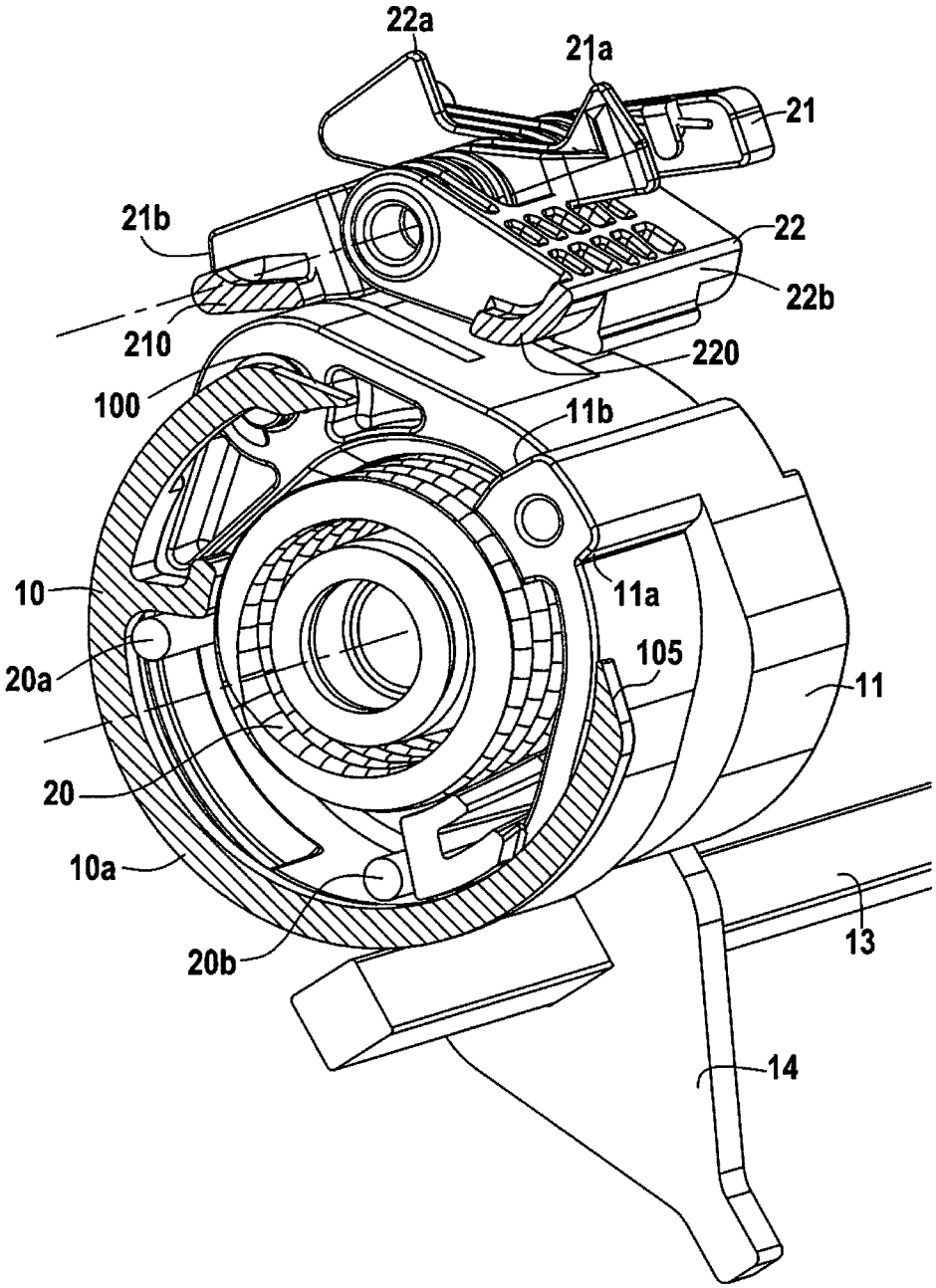
FIG. 8B shows a section view along plane B of the control device according to an embodiment of the invention.

FIG. 8A shows a partial top view of the control device according to an embodiment of the invention and FIG. 8B shows a section view along plane B of the control device according to an embodiment of the invention.

The control device 3 also comprises a first pawl 21 and a second pawl 22 scissor-mounted via a torsion spring 23 visible in FIG. 8.

As illustrated in FIGS. 8A and 8B, in a manual operating mode of the control device 3, the first pawl 21 cooperates, in a first position of the rotating element 11, on the one hand, with a first stop 11*a* for which provision is made on the rotating element 11 to hold the rotating element 11 in the first position during a part of the displacement of the control lever 10, and, on the other hand, with a first cam track 100 of the control lever 10 to disengage the first pawl 21 from the first stop 11*a* and release the rotating element 11.

Also in a manual operating mode of the control device 3, the second pawl 22 cooperates, in a second position of the rotating element 11, with a second stop 11*b* of the rotating element 11 and with a second cam track 105 of the control lever 10 to disengage the second pawl 22 from the second stop and release the rotating element 11.

The first and second pawls 21 and 22 each comprise a first end, 21*a* and 22*a* respectively, and a second end, 21*b* and 22*b* respectively. The second end 21*b* and 22*b* of each pawl 21 and 22 is arranged facing the rotating element 11 in the radial direction DR, and the first end 21*a* and 22*a* of each pawl 21 and 22 is opposed in the radial direction DR to the second end 21*b* and 22*b*. The first end 21*a* and 22*a* is therefore radially outward with respect to the second end 21*b* and 22*b* which is radially inward.

The first pawl 21 comprises a first axial protuberance 210 extending in the axial direction $D_A$ toward the control lever 10 and the second pawl 22 comprises a second axial protuberance 220 also extending in the axial direction $D_A$ toward the control lever 10. The first and second axial protuberances 210 and 220 are radially arranged facing the main portion 10*a* of the control lever 10 bearing the first and second cam tracks 100 and 105. In other words, the first and second protuberances 210 and 220 are arranged in a same radial plane than the first and second cam tracks 100 and 105 of the control lever 10.

The first and second pawls 21 and 22 are displaced by the external cowling 5.

When the external cowling 5 is closed, it is bearing on the first ends 21*a* and 22*a* of the first and second pawls 21 and 22, thus raising the first and second axial protuberances 210 and 220, thus disengaging the two pawls 210 and 220 of the rotating element 11. Automatic operation is then possible. The automatic operation is effected via an electromechanical member 28, such as an electrical actuator, coupled via a rod 29 to the rotating element 11 and configured to pivot the rotating element 11 between its first and its second positions.

When the external cowling is open, however, it no longer bears on the first ends 21*a* and 22*a* of the two pawls 21 and 22. The second ends 21*b* and 22*b* of the two pawls 21 and 22 are then radially lowered until they are in contact with the rotating element 11 on the one hand and until they are able to be in contact, for the first and second axial protuberances 210 and 220, with one of the first and second cam tracks 100 or 105 as a function of the displacement of the control lever 10.

Figure 9:
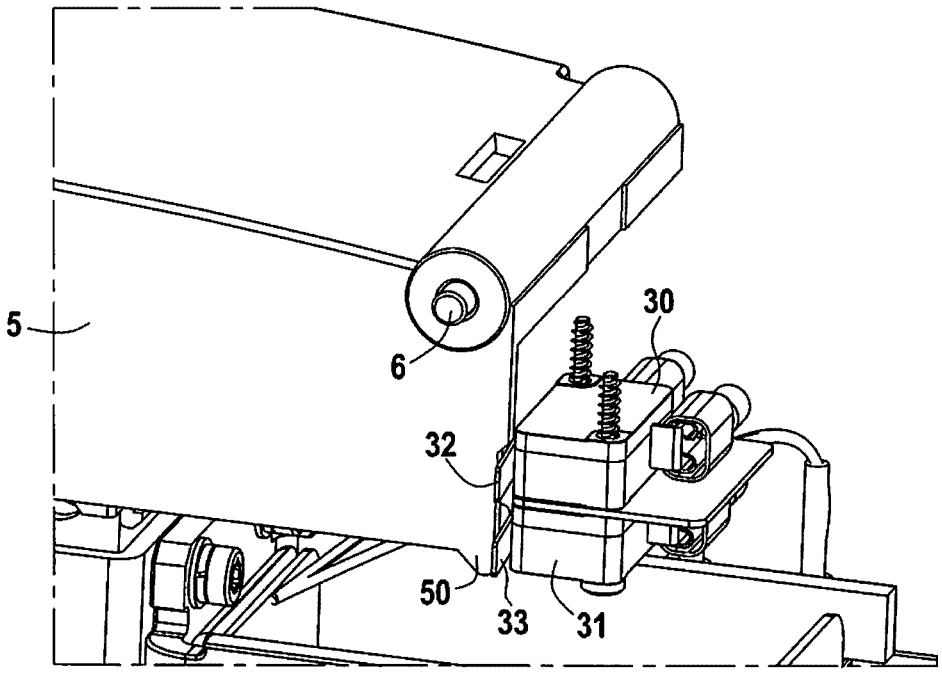
FIG. 9 shows a partial view of the external cowling 5 of the control device according to an embodiment of the invention.

As illustrated in FIG. 9 which represents a partial view of the external cowling 5, the control device 3 further comprises a first and second switch 30 and 31 mechanically cooperating with the external cowling 5 to enable or cut off the electrical power supply of the control device 3. Each switch 30 and 31 comprises a contact tab, 32 and 33 respectively, which is used to close the switch when the tab is pressed all the way to the track end. The external cowling 5 comprises an end 50 which, when the external cowling 5 is closed, comes to bear on the two tabs 32 and 33 of the switches 30 and 31 in such a way as to close the circuits of the switches 30 and 31.

The closing of the first switch 30 makes it possible to set up the electrical power supply of the control device 3 and in particular the electromechanical member 28 so that the control device 3 can operate in an automatic mode. The closing of the second switch 31 enables the sending of an item of information relating to the electrical power supply of the control device 3 for its operation in automatic mode.

The two switches 30 and 31 thus make it possible to supply electrical power to the control device 3 so that it operates in an automatic mode when the external cowling 5 is closed, the pawls 21 and 22 being disengaged from the rotating element, and to cut off the electrical power supply of the electromechanical member 28 when the external cowling 5 is open and thus to prevent automatic operation while the pawls 21 and 22 are engaged with the rotating element 11 and allow the manual operation of the control device 3.

Figure 10:
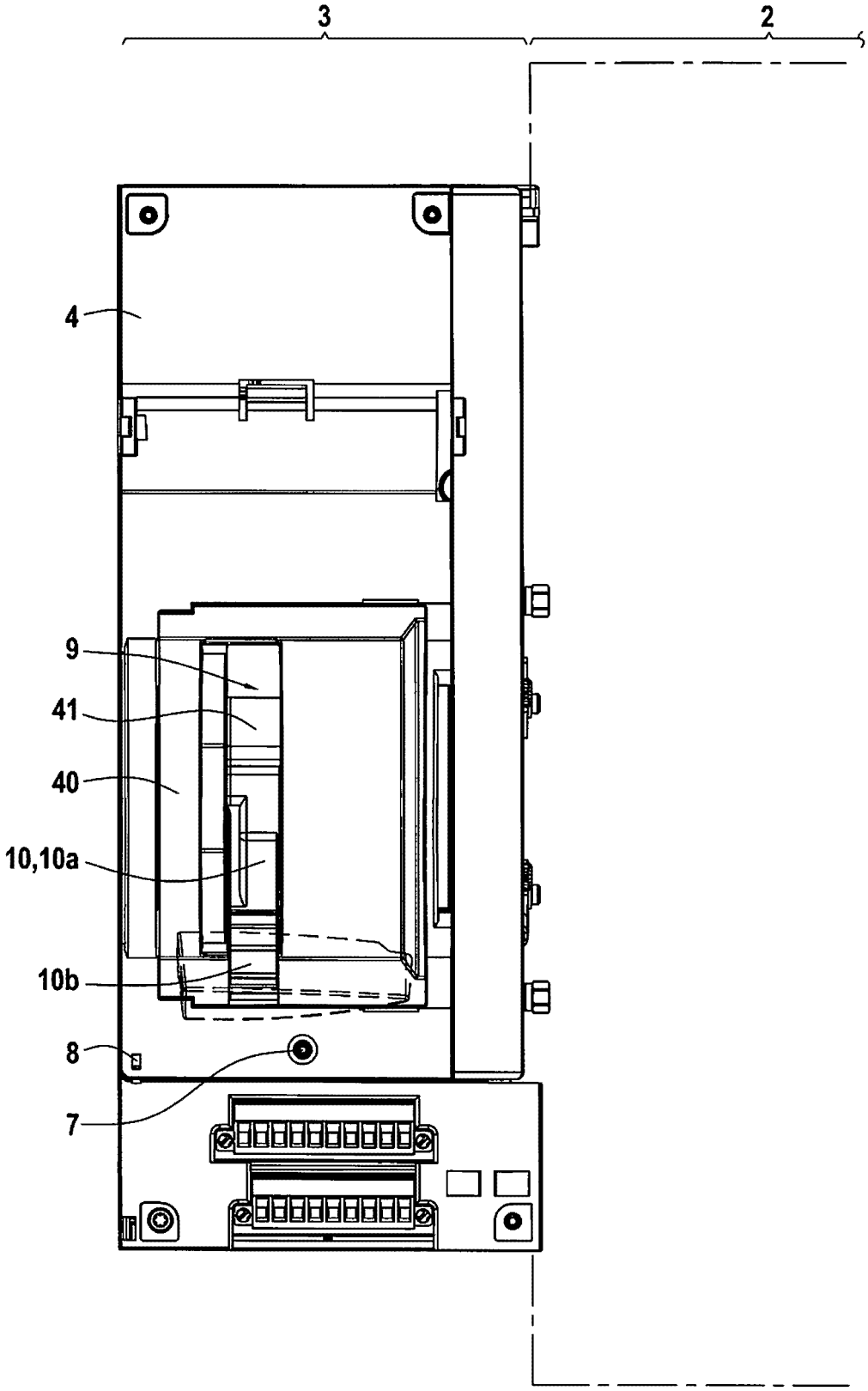
FIGS. 10 and 11 show a top view of the control device at two separate positions of the internal cowling.
Figure 11:
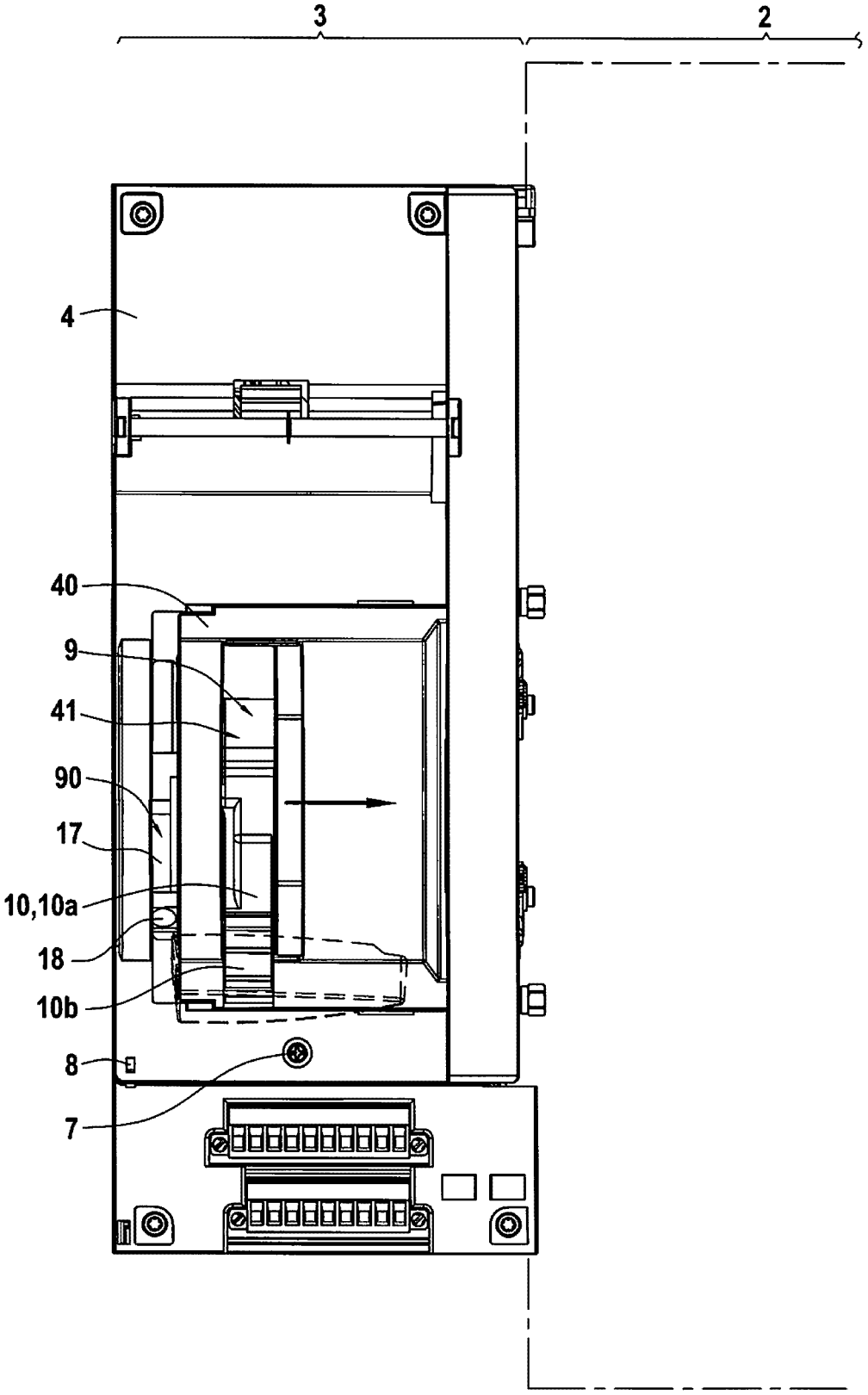

FIGS. 10 and 11 represent a first and a second perspective view of the control device 3 without the external cowling 5 and without the ergonomic handle 101 to simplify the interpretation of the figures.

As illustrated in FIG. 10, the control device 3 further comprises an internal cowling 40 mounted in translation on the unit 4 inside the external cowling 5 when the latter is closed on the unit 4. The internal cowling 40 comprises a slot 41 traversed by the radial extension 10*b* of the control lever 10. The slot 41 of the internal cowling 40 has a width, i.e. a dimension in the axial direction $D_A$, that is greater than the width, i.e. the dimension in the axial direction $D_A$, of the radial extension 10*b* of the control lever 10 which makes it possible to displace the internal cowling 40 along the axial direction $D_A$.

As illustrated in FIG. 11, which shows the same perspective view as FIG. 9 but with the internal cowling 40 removed, the unit comprises a second slot 90 extending parallel to the first slot 9 of the unit 4, i.e. in a direction perpendicular to the axial direction $D_A$. The second slot 90 is made facing the forcing lever 17, and extends over the whole track of the free end 17*c* of the forcing lever 17. The first slot 9 is thus arranged in the axial direction $D_A$ between the second slot 90 and the part 2 intended for electrical connections. The ergonomic handle 101 is configured and arranged to not extend in the radial plane into which the radial extension 17*b* of the forcing lever 17 extends, so as not to hinder access to the forcing lever 17.

The internal cowling 40 is shaped to cover the second slot 90 of the unit 4 when it is in a first position and give access to the second slot 90 of the unit 4 when it is translated into a second position. The control device 3 further comprises a compression spring arranged in the axial direction $D_A$ between the internal cowling 40 and a stop of the unit 4. The compressing spring by default holds the internal cowling 40 in its first position wherein the internal cowling 40 covers the second slot 90 preventing any access to the orifice 18 of the forcing lever 17. The compression spring is compressible to allow the translation of the internal cowling 40 in the axial direction $D_A$ to give access to the second slot 90 of the unit.

The invention claimed is:

1. A control device for controlling switching of contacts in an electrical apparatus comprising a unit inside which are mounted a control lever in a pivot connection with the unit and configured to be rotationally displaced between a first position corresponding to another position;

wherein the contacts are closed on a primary power supply and a second position corresponding to the another position, wherein the contacts are closed on a secondary power supply, a rotating element connected to the control lever by an intermediate shaft, an actuating shaft mechanically connected to the rotating element and to the contacts and configured to pivot between the first and second positions to switch between the contacts, the unit further comprising a slot traversed by the control lever to allow the unit to be actuated from outside the unit in a manual operating mode of the control device;

wherein the control device comprises a torsion spring including a first end cooperating with the control lever and a second end cooperating with the rotating element; and a first pawl and a second pawl scissor-mounted via the torsion spring, the first pawl cooperating, in a manual operating mode of the control device, with a first stop of the rotating element in a first position of the rotating element and with a first cam track of the control lever to disengage the first pawl from the first stop and release the rotating element; and the second pawl cooperating, in a manual operating mode of the control device, with a second stop of the rotating element in a second position of the rotating element and with a second cam track of the control lever to disengage the second pawl from the second stop and release the rotating element.

2. The control device as claimed in claim 1, wherein the unit comprises a cowling displaceable between an open position and a closed position, the cowling being configured to, in the closed position, prevent any manual access to the control lever and disengage the first and second pawls from the rotating element to prevent any cooperation between the first and second pawls and the rotating element and allow the operation of the control device in an automatic mode, and to, in the open position, engage the first and second pawls in contact with the rotating element and allow the operation of the control device in manual mode.

3. The control device as claimed in claim 2, further comprising at least one switch mechanically cooperating with the cowling to enable or cut off an electrical power supply of the control device allowing its operation in automatic mode and/or to enable or disable sending of an item of information relating to the electrical power supply of the control device for its operation in automatic mode.

4. The control device as claimed in claim 2, wherein the cowling is transparent.

5. The control device as claimed in claim 2, wherein the cowling is kept in the closed position by a screw that is removable using a screwdriver.

6. The control device as claimed in claim 1, wherein the unit further comprises an additional slot arranged facing an actuator directly engaging with the actuating shaft and allowing the manual forcing of an opening or closing of the contacts, and an internal cowling mounted in translation between an idle position wherein the internal cowling covers the additional slot and a working position wherein the internal cowling gives access to the additional slot.

7. The control device as claimed in claim 6, wherein the unit further comprises an elastic means making it possible to return the internal cowling to its idle position after a transition to the working position.

8. The control device as claimed in claim 6, wherein the cowling covers, in the closed position, the internal cowling, preventing any manual access to the additional slot.

9. The control device as claimed in claim 1, comprising an ergonomic handle attached to a free end of the control lever.

10. An electrical switching device allowing a supply of electrical power to a plurality of electrical members via electrical contacts, the electrical apparatus comprising at least one control device for controlling the switching of the contacts in the electrical apparatus as claimed in claim 1.

* * * * *